US005313760A

United States Patent [19]

Tojo

[11] Patent Number: 5,313,760

[45] Date of Patent: May 24, 1994

[54] BUILDING WALL CONSTRUCTION METHOD

[76] Inventor: Tadatsune Tojo, 588-21, Mizonokuchi, Takatsu-Ku, Kawasaki-shi, Kanagawa-Ken, Japan

[21] Appl. No.: 875,385

[22] Filed: Apr. 29, 1992

[30] Foreign Application Priority Data

Feb. 27, 1992 [JP] Japan ..... 75711

[51] Int. Cl.[5] ..... E04G 21/14; E04B 1/38

[52] U.S. Cl. ..... 52/747; 52/513; 52/713

[58] Field of Search ..... 52/747, 513, 512, 508, 52/509, 235, 712, 713

[56] References Cited

U.S. PATENT DOCUMENTS 3,110,131 11/1963 Jeffress ..... 52/513
4,720,952 1/1988 Fricker ..... 52/235
4,776,143 10/1988 Pointner ..... 52/509
4,783,941 11/1988 Loper et al. ..... 52/509

*Primary Examiner*—Michael Safavi
*Attorney, Agent, or Firm*—Andrus, Seales, Starke & Sawall

[57] ABSTRACT

Disclosed is a building wall construction method for forming a decorative wall by installing wall panels of a predetermined thickness to a wall body. This method comprises steps of attaching fittings to a surface of the wall body in an upright direction at predetermined intervals, the fittings being long enough to arrange a plurality of the wall panels along each of the fittings when the wall panels face the wall body, and having through holes at predetermined intervals in a surface opposite to widthwise edge surfaces of the wall panels; and inserting nibs into the through holes of the fittings and holes formed in the widthwise edge surfaces of the wall panels and holding the wall panels so as to construct a decorative wall.

4 Claims, 9 Drawing Sheets

BUILDING WALL CONSTRUCTION METHOD

BACKGROUND OF THE INVENTION

The present invention relates to a building wall construction method, by which a decorative wall can be formed using wall panels such as marble, granite or other stones, or a special synthetic resin.

FIELD OF THE INVENTION

Stone panels, such as marble or granite, or panels of other materials are being increasingly used as facings for internal/external building walls and floors to give a building a magnificent and elegant appearance. In concert with this usage tendency, the prices of marble and other materials used for facings are rising, as is the labor cost for journeymen to attach the stones to walls. Accordingly, the cost per construction measurement unit has increased too much, making it difficult to construct a building using wall panels, such as marble. (Hereafter, the term "marble" is used to represent all wall panel materials.)

Counter measures taken to prevent a high rise in the price of marble for wall panels have included sourcing and importing marble from all parts of the world, and using artificial marble made from a special synthetic resin.

There are however very few journeymen who have the skills necessary to attach and correctly align decorative marble panels to a wall body for an elegant appearance. Even if the price of marble for wall material does not continue to rise, therefore, labor costs will inevitably go up because of the relative scarceness of competent journeymen.

A conventional method of building wall construction will now be explained referring to FIGS. 7 and 8. FIG. 7A is a vertical partial cross section showing how marble is attached to a wall body. FIG. 7B is a front view showing the same.

In FIG. 7, hole-in anchors 51 are formed in a wall body 50 made of concrete, metal or wood.

Reference numeral "52" denotes a square marble wall panel of a predetermined size. Slits 53 are cut in and formed in both widthwise upper and lower edge surfaces of the marble wall panel 52.

Fittings 54 are made of, for example, stainless steel. Ends of the fittings 54 are inserted into the slits 53 of the marble 52, and the other ends are fixed to the hole-in anchors 51, thereby tightly securing the marble 52 to the wall body 50.

Back-up materials 55 are to be inserted between the wall body 50 and the marble 52 to align the surface of a decorative wall.

Conventional work procedures using the above-described components will now be explained. First, the hole-in anchors 51 are driven into the wall body 50, and are fixed to the ends of the individual fittings 54 by welding, for example. Then, a highly durable adhesive or curing agent is applied to the inner surfaces of the slits 53 of the marble 52, and the other ends of the fittings 54 are inserted to the individual slits 53 and adhere therein. These procedures are performed on the upper and lower edge surfaces of the marble 52. A plumb line is used to adjust the position of the marble 52 so that joints are aligned and the surfaces of all the marble panels are even.

Since in this method the fittings 54 pull the marble 52 toward the wall body 50, this wall assembly is strengthened by the force pulling the marble 52 from the wall body 50, but is weakened by the force pushing the marble 52 toward the wall body 50. These dynamic forces are balanced by the back-up materials 55 which are installed between the wall body 50 and the marble 52 to align the surfaces of horizontally and vertically adjacent marbles 52.

The same work procedures are repeated from the lower portion to the upper portion of the wall body 50 using a plumb line to adjust and align the individual marbles 52, until a marble decorative wall is completed.

When the conventional method described above is used, a great deal of skill is necessary for workers to perform this facing work, and per hour job productivity is limited, even when highly skilled workers are employed.

Another method is described below which involves rationalizing the above-described work procedures.

Reinforcing rods are vertically and horizontally welded to the hole-in anchors 51 formed in the wall body 50 in advance. The fittings 54 are installed with their wall-side ends anchored to the reinforcing rods, and the other ends inserted into the slits 53 of the marble 52 as described above, thereby forming a marble decorative wall. Although this method facilitates the attachment of the fittings 54 to the hole-in anchors 51, it cannot drastically reduce work steps and highly skilled workers are still required.

Another method is therefore being developed. According to this method, an L-shaped fitting 60 shown in FIG. 8 made of, for example, stainless steel is produced and attached to the wall body 50 while the level of the fitting 60 is adjusted by a bolt, or other means. Then, a slit in a marble is fitted over a tap 61 which is formed on the horizontal surface of the fitting 60, thus providing a wall. This method eliminates the attachment of fittings to hole-in anchors, and reduces the considerable number of work steps. However, the fittings 60 in this method are made of stainless steel and are very expensive. Further, workers must have a great deal of skill to accurately position and attach the marble to the wall body 50 with the fittings 60, and their productivity is limited, reducing yield.

SUMMARY OF THE INVENTION

In view of the above-described shortcomings, it is an object of the present invention to provide a building wall construction method which can accurately fix a wall decorative material, such as marble, without requiring highly skilled labor.

It is another object of the present invention to provide a building wall construction method which can reduce the number of work steps.

It is a further object of the present invention to provide a building wall construction method which can form a properly aligned decorative wall while compensating for the surface level variations of a wall.

To achieve the above-described objects, a building wall construction method according to the present invention comprises steps of attaching fittings to a surface of a wall body in an upright direction at predetermined intervals, the fittings being long enough to arrange a plurality of wall panels along each of the fittings when a plurality of the wall panels face the wall body, and having through holes at predetermined intervals in a surface opposite to widthwise edge surfaces of the wall panels; and inserting nibs into the through holes of the fittings and slits formed in the widthwise edge surfaces of the wall panels and holding the wall panels so as to construct a decorative wall.

The fitting can be an elongated, L-shaped metal body, which has the required number of through holes in one side and wall body attaching holes in the other side.

The fitting can also be a combination of an elongated, flat board having the required number of through holes and auxiliary fittings to attach the elongated, flat board to a wall body.

Marble wall panels are especially desirable to be used as the wall panels of the present invention.

DESCRIPTION OF THE PREFERRED EMBODIMENTS

Figure 1C:
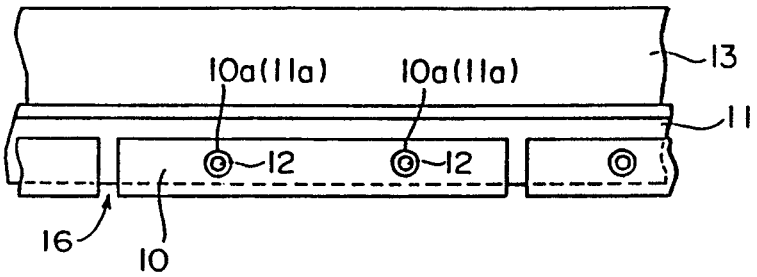
FIGS. 1A to 1C are explanatory diagrams illustrating a building wall construction method according to the present invention.
Figure 1A:
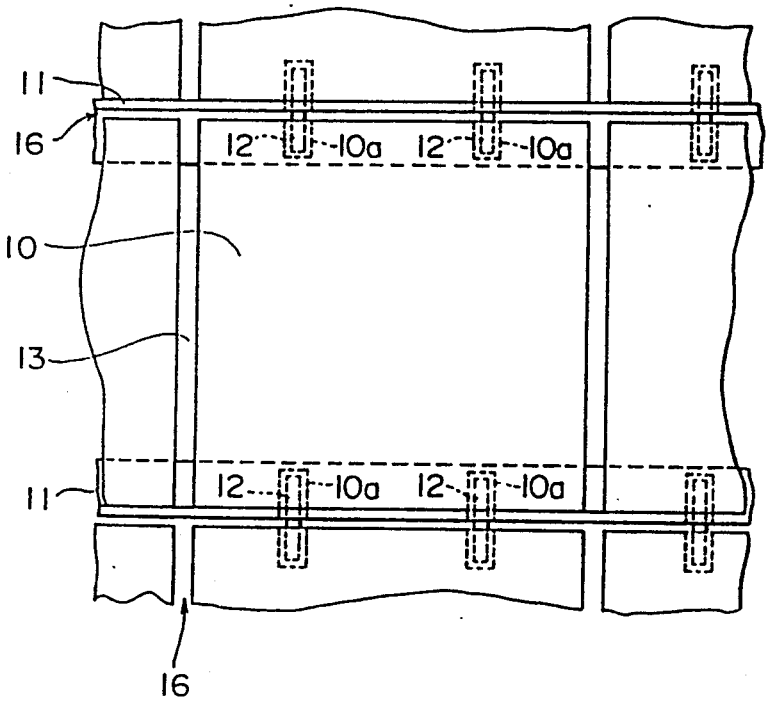

FIGS. 1A thorough 1C are diagrams for explaining the first embodiment of the present invention; FIG. 1A is a partial front view, FIG. 1B a partial side cross section and FIG. 1C a partial plan cross section. The sizes of the individual components will be given in this embodiment for comprehensive explanation. The present invention is not however limited to components of these sizes.

Figure 1B:
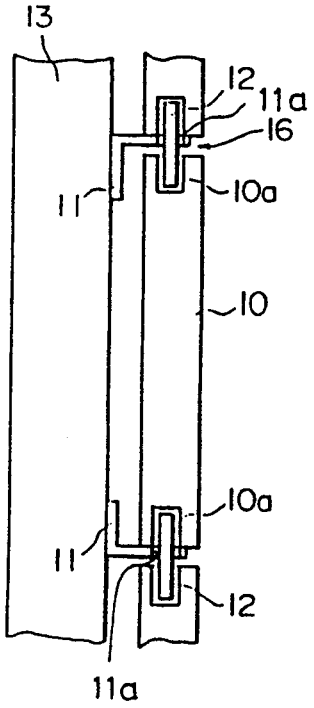

In FIGS. 1A to 1C, a marble 10 is a square wall panel of, for example, 600×600 mm. The marble 10 has two holes 10*a* cut and formed in both widthwise upper and lower edge surfaces. The holes 10*a* are to be positioned, for example, 150 mm away from the ends of the marble 10 (300-mm interval between the holes). The diameter of the hole 10*a* is 6 mm $\phi$, for example. This diameter is determined by the thickness of the marble 10, and the sizes of nibs 12.

A fitting 11 is a long, L-shaped member fabricated from, for example, stainless steel. This long, L-shaped member 11 is 4 mm thick and 4 to 6 m long, for example. Through holes 11*a* are bored in one surface of the L-shaped member 11 (the surface that is perpendicular to a wall after attachment) at a regular pitch, such as 300 mm, 305 mm, 300 mm, . . . . These pitches are for, in this embodiment, the through holes 11*a* for the marble 10 of 600×600 mm and joints 16 of 5 mm. The size of the marble 10 and the width of the joint 16 can be arbitrarily determined. The diameter of the through holes 11*a* is 6 mm $\phi$, for example.

Since the L-shaped member 11 is fabricated in advance in a factory, etc., the spacing or pitch and size of the through holes 11*a* in the L-shaped member 11 is precisely controlled, and the marble 10 can be very accurately positioned, as will be described later.

The nib 12 is a cylinder of 5 mm $\phi$ in diameter, and of 30 mm in length, for example. Since there is some play for the nib 12 with respect to the slit 10*a* in the marble 10 and the through hole 11*a* of the L-shaped member 11, the nib 12 can be inserted into the hole 10*a* and the through hole 11*a* at a slight angle.

A wall body 13 can be made of concrete, metal, wood or other solid materials.

The work procedures of the present invention using the above-described components will now be explained referring to FIG. 2.

The L-shaped member 11 is attached to the wall body 13 while its level is checked with a plumb line, etc. The L-shaped member 11 must be accurately positioned because this positioning directly affects alignment when the marble 10 is installed. Since the length of the long, L-shaped member 11 is 4 to 6 m, the L-shaped member 11, if accurately positioned, will exactly position a plurality of the marbles 10.

Likewise, the remaining L-shaped members 11 are to be attached to the entire wall body 13 in the upright direction at predetermined intervals for the embodiment (605-mm intervals shown in FIG. 1).

When the rigid section on the side of the wall body (strut) 13 is an iron frame, since the iron frame is produced in a factory, projections used to hold the L-shaped members 11 can be formed in advance, so that the attachment of the L-shaped members 11 can be quicker and more exact.

When the wall body 13 is made of concrete, reinforcing rods or hole-in anchors may be positioned in that wall body 13 so that the L-shaped member 11 may be welded thereto.

When the attachment of the L-shaped members 11 is completed, the marbles 10 are to be arranged and fixed. More specifically, a fast-drying curing agent or adhesive is applied to the inner surfaces of the holes 10*a* in the upper edge surface of the marble 10 installed at a lower level. The holes 10*a* and the through holes 11*a* of the L-shaped member 11 are aligned and the nibs 12 are inserted therein. The upper halves of the nibs 12 protrude from the upper surface of the L-shaped member 11 at this time.

Under these conditions, the curing agent is applied to the inner surfaces of the holes 10*a* in the lower edge surface of the marble 10 which is to be positioned at the higher level. The holes 10*a* are then fitted over the protruding nibs 12. Since the through holes 11*a* have a slightly larger diameter than the nibs 12, the marble 10 can be tilted at a predetermined angle. As indicated by the chain double-dashed line in FIG. 2, therefore, the holes 10*a* in the lower edge surface of the marble 10 can be fitted over the protruding nibs 12 while that marble 10 is tilted. Then, with the nibs 12 fitted in the holes 10*a*, the marble 10 is moved in the direction indicated by the arrow in FIG. 2, and the nibs 12 are put into the holes 10*a* in the upper edge surface of the marble 10 in the manner as described above to hold the marble 10. As a result, not only the transversely opposite sides of the marble 10 can be accurately positioned, but also the final surface level of the marble 10 can be compensated for. The above procedures are repeated, thereby efficiently constructing the surfaces of building walls.

Since this construction method accurately positions all the sides of the marble 10, the exact widths of joints 16 can be obtained, ensuring preferable facing.

In the above embodiment, the one-by-one attachment to the wall body 13 of the L-shaped members 11 has been explained. If, however, a grid holding member is fabricated with a plurality of the L-shaped members 11 fixed (e.g., welded) to it at predetermined intervals (605-mm intervals when using marble panels of the size described in the embodiment), and the marble 10 is arranged and fixed thereto in order, the procedure of attaching the L-shaped members 11 to the wall body 13 will be simplified, no highly skilled labor will be required and working time can be reduced.

Further, construction of a decorative wall with marble has been explained in the above embodiment. Wall panels other than marble, such as natural woods, special plastic panels and porcelain panels can be used for that decorative wall, and have the same effects and advantages as in the above-described embodiment.

Figure 3B:
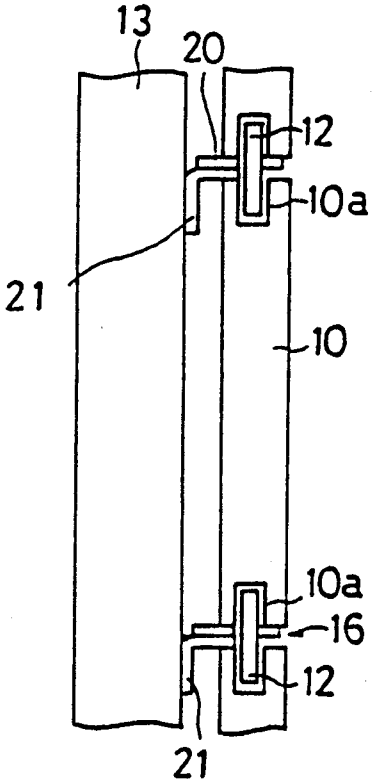
FIGS. 3A to 3C are diagrams for explaining the second embodiment of the present invention.
Figure 3A:
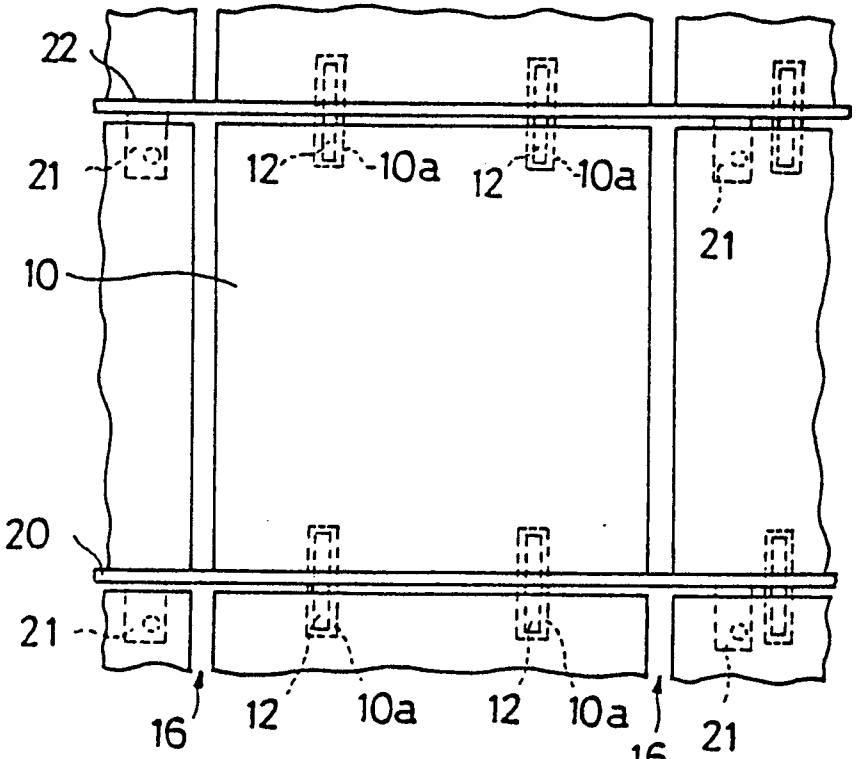
Figure 3C:
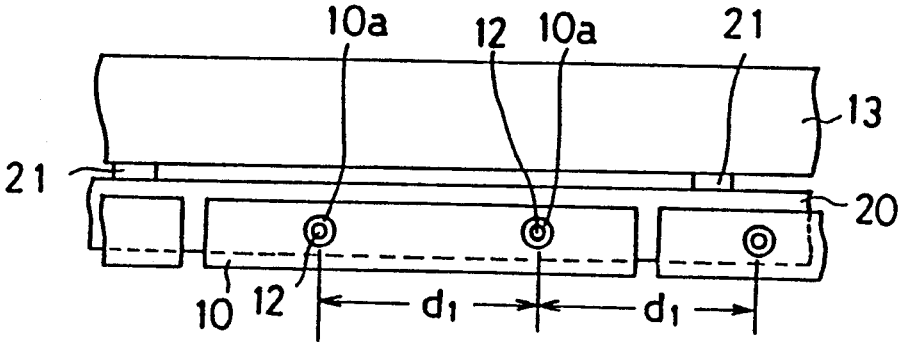

FIGS. 3A to 3C are diagrams for explaining another embodiment of the present invention; FIG. 3A is a partial front view, FIG. 3B a partial side cross sectional view and FIG. 3C a partial plan cross section. The reference numerals used to denote and identify components in FIGS. 3A to 3C are the same as those used to identify corresponding or identical components in FIG. 1.

Figure 4:
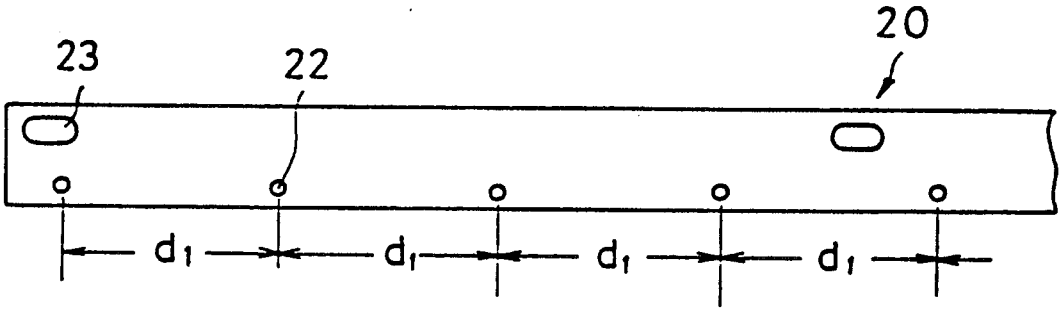
FIG. 4 is a plan view illustrating a long, flat board according to the second embodiment of the present invention.

In this embodiment, the long, L-shaped members 11 used as fittings in the embodiment shown in FIG. 1 are replaced with long, flat boards 20 of stainless steel, for example. The long, flat boards 20 are securely attached to a predetermined part, e.g., the wall body 13, with auxiliary fittings 21. It will be convenient for the long, flat boards 20 to be 4 mm thick, for example, and of several standard lengths. As shown in FIG. 4, through holes 22 are regularly positioned in the long, flat board 20 at equal spacing or pitches d1. These pitches can be changed as needed depending on the size of the marble panels and the structure of a building. Elongated holes 23, terminated by large diameter semicircles, of a number dictated by the job requirements, are also cut and formed in the long, flat board 20, but at greater intervals than those used for the through holes 22.

Figure 5:
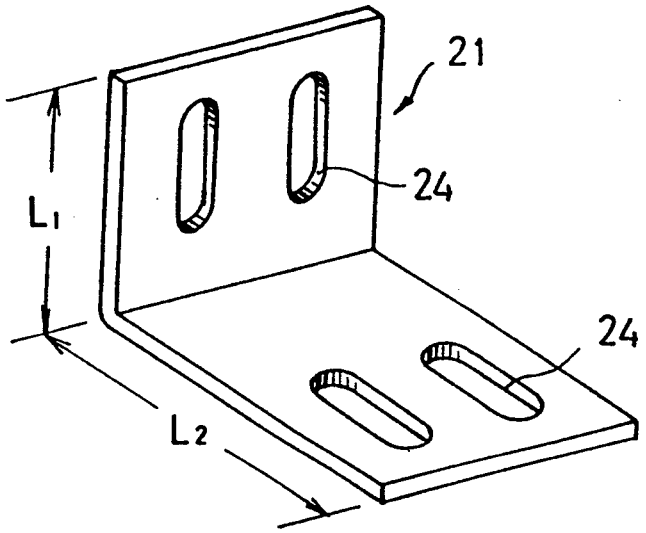
FIG. 5 is a perspective view illustrating the structure of an auxiliary fitting according to the second embodiment of the present invention.

Since the elongated, flat boards 20 can be prepared in a factory, for example, as in the previous embodiment, the through holes 22 can be placed at the prescribed pitch and sized exactly. As shown in FIG. 5, the auxiliary fittings 21 to fix the long, flat board 20 to the wall body 13 are L-shaped fittings with unequal length sides. The required number of elongated holes 24, two in this case, are bored on either side.

The auxiliary fittings 21 are secured to the long, flat board 20 through the elongated holes 24 on one of the sides, and fix the same to the wall body 13 through the elongated holes 24 on the other side. These elongated holes 24 are very useful to compensate for surface level variations of a concrete wall, for example. The auxiliary fittings 21 are designed to be L-shaped with unequal length sides because compensation greater than those permitted by the elongated holes 24 can be made by using alternate sides of the auxiliary fittings 21.

Figure 6A:
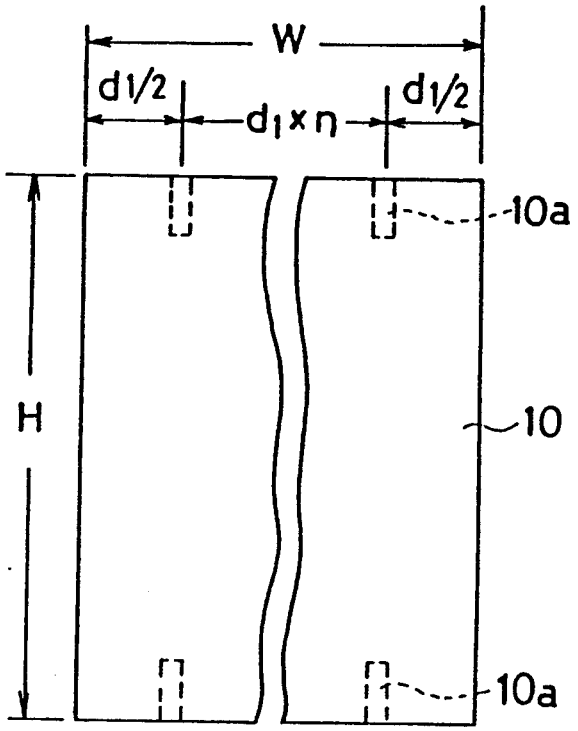
FIGS. 6A and 6B are a front view and a plan view respectively illustrating the structure of a marble wall material according to the first and second embodiments of the present invention.
Figure 6B:
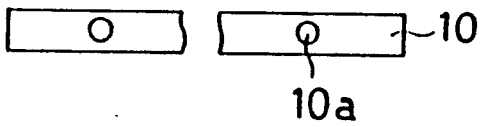
Figure 7A:
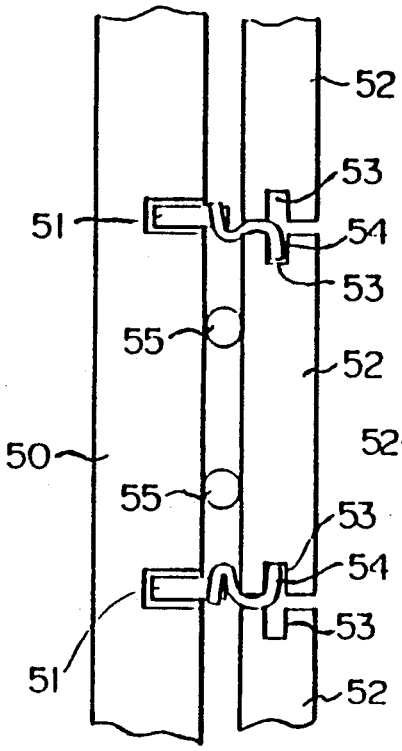
Fig. 7A PRIOR ART
FIGS. 7A and 7B are explanatory diagrams illustrating how wall panels are attached according to the prior art.
Figure 7B:
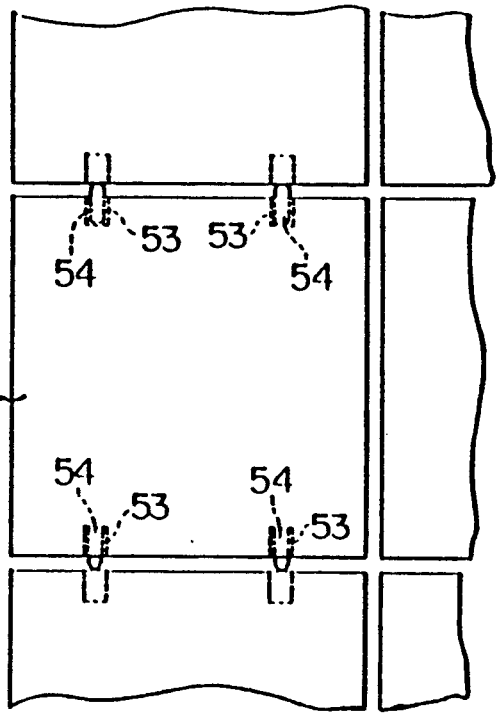
Fig. 7B PRIOR ART
Figure 8:
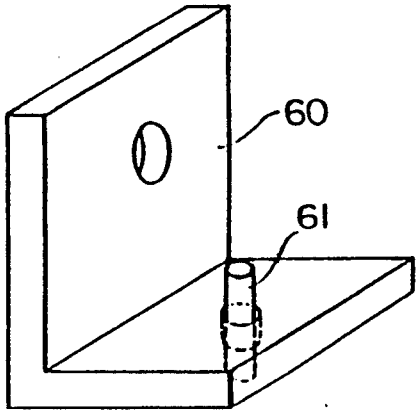
Fig. 8 PRIOR ART
FIG. 8 is a perspective view illustrating a fitting for a marble wall material used in a conventional wall construction method.

FIG. 6 illustrates an example of the marble 10 as a proper wall panel to be used in the present invention. The two holes **10*a* are cut and formed in the upper and lower edge surfaces of the marble 10, as described above. The interval between the holes 10*a* naturally varies depending on the size of the marble 10. This interval is ($n \times d1$), where n is an integer of 1 or greater and d1 is the interval for the through holes 11*a* of the long, L-shaped member 11 in the first embodiment or between the through holes 22 of the long, flat board 20** in the second embodiment. The height H should be constant.

The width W of the marble 10 is set to ($d1 \times n + d1$). The interval between the hole **10*a* and the edge is ($d1/2$). When the adjacent marbles 10 are attached, the intervals ($d1/2$) of both the marbles 10 are added together, yielding d1. The sequential attachment of the marble 10 to auxiliary fittings 21 or to the long, flat board 20** can be performed exactly.

The work procedures in the second embodiment using the above-described components will now be explained. First, the long, flat board 20 is attached to the wall body 13 using the auxiliary fittings 21. This attachment can be performed using a gauge or tool of a proper size, or using a plumb line to accurately align the long flat board 20 while compensating for the surface level variations of the wall body 13. The long, flat board 20 must be accurately positioned because this positioning directly affects the alignment of the marble 10 when it is installed.

In the second embodiment of the present invention, the auxiliary fitting 21 shown in FIG. 5 is used to attach the long, flat board 20. The auxiliary fitting 21 has the elongated holes 24 for attachment to the long, flat board 20 and for fixing it to the wall body 13. Adjustments to compensate for common concrete wall surface level variations can be easily made. More specifically, even if the surface of the wall body 13 is slightly rough, the long, flat board 20 can accurately be attached using the elongated holes 24 of the auxiliary fittings 21 and alternate sides of the fittings 21 as necessary, providing a decorative wall with aligned marble facings.

When the wall body (strut) 13 is made of metal, since that wall body 13 is manufactured in a factory, protrusions for holding the auxiliary fittings 21 are prepared in advance on the wall body 13, and the long, flat board 20 can be more quickly and precisely attached.

Figure 2:
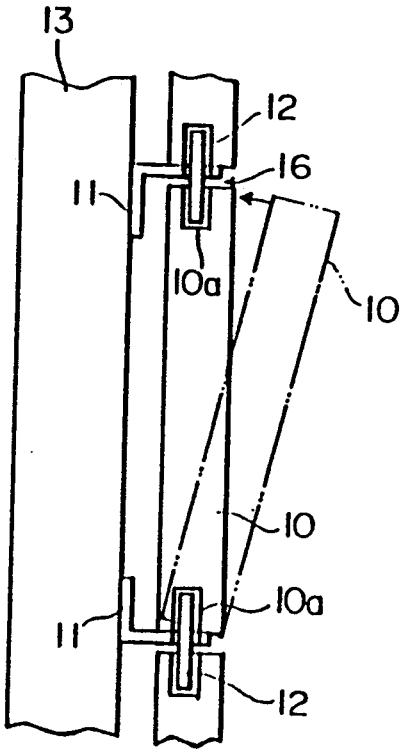
FIG. 2 is a diagram for explaining procedures for attaching a marble according to the first embodiment of the present invention.

When the attachment of the long, flat boards 20 is completed, the marbles 10 are to be arranged in the same manner as that described referring to FIG. 2.

As described above in detail, according to the present invention it is possible to provide a building wall construction method which is suitable even for unskilled workers, increases the facing accuracy of marble panels through adjustments to compensate for surface level variations of a wall, and significantly improves yield.

Further, according to the present invention, a building wall construction method which can reduce the number of work steps can be provided.

Moreover, according to the present invention, a building wall construction method by which surface level variations of a wall body can be compensated for so as to form a properly aligned decorative wall can be provided.

The present invention is not limited to the above-described embodiments, and can be modified within the scope of the invention.

What is claimed is:

1. A building wall construction method, for forming a decorative wall by installing wall panels on a wall body, said wall panels having spaced holes in the upper and lower surfaces thereof, said method comprising the steps of:

attaching fittings to a surface of the wall body at predetermined intervals in a vertical direction, sets of said fittings being aligned in a horizontal direction, said fittings being formed of L-shaped members having a pair of orthogonal, planar flanges, each of which is suitable for attachment to the wall body, the flanges of said fittings having unequal depth;

fastening an elongated flat member to each horizontally aligned set of said fittings for traversing the wall body, each of said flat members being capable of supporting a plurality of the wall panels, said members having through holes extending through said members at predetermined horizontally spaced intervals;

inserting nibs into said through holes of said elongated member, to extend from either side of said elongated member;

inserting the nibs into the holes in the horizontal upper surface of a wall panel placed below the elongated member so as to retain the panel on the elongated member in generally vertical alignment with the elongated member; and inserting the nibs in the holes in the horizontal lower surface of a wall panel placed above the elongated member so as to retain the panel on the elongated member in generally vertical alignment with the elongated member and to form a decorative wall from the wall panels.

2. A building wall construction method according to claim 1 wherein the step of inserting the nibs into the elongated member is further defined as inserting the nibs to be free to move vertically with respect to the elongated member; and wherein the steps of inserting the nibs into the holes in the upper horizontal surface of the wall panel is further defined as positioning the nibs to extend from the upper surface of the elongated member.

3. A building wall construction method according to claim 1, wherein an adhesive or a curing agent is applied to inner surfaces of said holes when said nibs are put in said holes formed in each of said wall panels.

4. A building wall construction method according to claim 1, wherein said wall panels are square marble pieces.

* * * * *